United States Patent [19]

Ebihara

[11] Patent Number: 4,546,909

[45] Date of Patent: Oct. 15, 1985

[54] STAPLER

[75] Inventor: Yoshiyuki Ebihara, Tokyo, Japan

[73] Assignee: Etona, Co., Ltd., Tokyo, Japan

[21] Appl. No.: 571,533

[22] Filed: Jan. 17, 1984

[51] Int. Cl.[4] ..... B25C 5/11

[52] U.S. Cl. ..... 227/120; 227/155

[58] Field of Search ..... 227/120, 129, 134, 155

[56] References Cited

U.S. PATENT DOCUMENTS

| | | | |
|---|---|---|---|
| 2,702,383 | 2/1955 | Buechler | 227/134 |
| 3,583,622 | 3/1969 | Graeff | 227/120 |
| 4,463,890 | 8/1984 | Ruskin | 227/120 X |

FOREIGN PATENT DOCUMENTS

| | | | |
|---|---|---|---|
| 136935 | 10/1979 | Japan | 227/134 |

*Primary Examiner*—Paul A. Bell

*Attorney, Agent, or Firm*—Wenderoth, Lind & Ponack

[57] ABSTRACT

The present invention relates to a construction of a stapler having a base, a staple magazine hinged to the base, a magazine follower arranged in the staple magazine, and a guide body positioned over the staple magazine and hinged to the base. The stapler is characterized by two novel elements. At least one first punched-out element extends between the guide body and a top surface of the staple magazine in order to absorb elastic stress created between the guide body and the staple magazine when the stapler is operated. At least one second punched-out element extends between the base and a bottom surface of the staple magazine in order to absorb elastic stress created between the base and the staple magazine when the stapler is operated.

5 Claims, 7 Drawing Figures

STAPLER

BACKGROUND OF THE INVENTION

1. Field of the Invention

The present invention relates to a stapler.

2. Description of the Prior Art

A conventional stapler is provided with too many parts to be assembled easily in spite of its simple function of stapling an object to be stapled. Accordingly, it is impossible to justify the production cost of most conventional staplers. Also, the cost of miniaturizing the dimensions of conventional staplers is another limitation upon production.

A novel miniature stapler provided according to the present invention is free of the above-mentioned conventional defects. Furthermore, such defects are not so great even when the stapler is produced in a medium size or a large size. Accordingly, it is easy to obtain efficiency in mass production of a stapler and to keep costs down regardless of the size of the stapler.

SUMMARY OF THE INVENTION

The present invention provides an improved construction of a stapler.

A conventional mechanism is advantageously improved for absorbing the stress created when closing the gap between the front end portion of a projecting frame of an intermediate layer and a guide body of an upper layer and another gap existing between the front end portion of said frame and a lower base. Consequently, an independent member for absorbing the stress is not required. Thus, the construction of the frame and the frame cover of the stapler may be relatively miniaturized.

In the above-mentioned improvement, all members for absorbing the stress are made by partially punching out of a basic material used for the above-mentioned members constituting the stapler and are engaged with the other mechanisms having conventional mechanical action.

DESCRIPTION OF THE PREFERRED EMBODIMENTS

The present invention relates to a mechanism for absorbing the elastic stress of a stapler.

Figure 5:
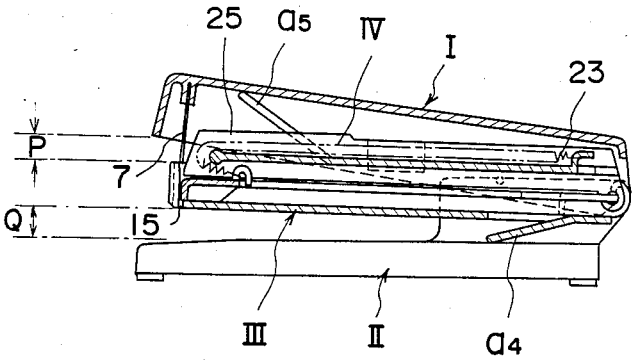
FIG. 5 is a side elevational view of an assembly of the parts shown in FIG. 4.

As is known, the members constituting a stapler necessitate the existence of gap P (FIG. 2 and FIG. 5) preliminarily in relation to the front end portion of a staple magazine III provided with a feeder for feeding staples by partially punching the same. By applying an impact to a guide body I, a staple is driven through a gap Q (FIG. 2 and FIG. 5) to a base II downward in relation to the front end portion of the staple magazine III. Therefore, a spring body in the form of a coil or a panel has been conventionally fixed, in most cases, to the base II and the guide body I which act in combination as a mechanism for absorbing the elastic stress. Also, the guide body I and the base II form the above-mentioned gaps P and Q and are fixed to an upper surface and a bottom surface, respectively, of the staple magazine III prior to the use of the stapler.

In order to eliminate the above-mentioned conventional members for absorbing the elastic stress, according to the present invention, two (2) elastic pieces $a_1$,$a_2$ on the upper surface of the guide body I and also another elastic piece $a_3$ on a bottom of the base II are integrally formed with the guide body I and the base II, respectively, by partially punching out parts thereof.

Furthermore, in such a type of a stapler necessitating a frame cover IV (FIG. 4) for securing a spring for energizing a feeding force to a feeder of the staples, it is suitable to form an elastic piece $a_4$ formed by partially punching out the wall portions of the staple magazine III and the frame cover IV and also to punch out another two (2) elastic pieces $a_5$ and $a_6$, respectively.

Hereinafter, embodiment (1) will be described in detail with reference to the drawings of the present invention.

Figure 1:
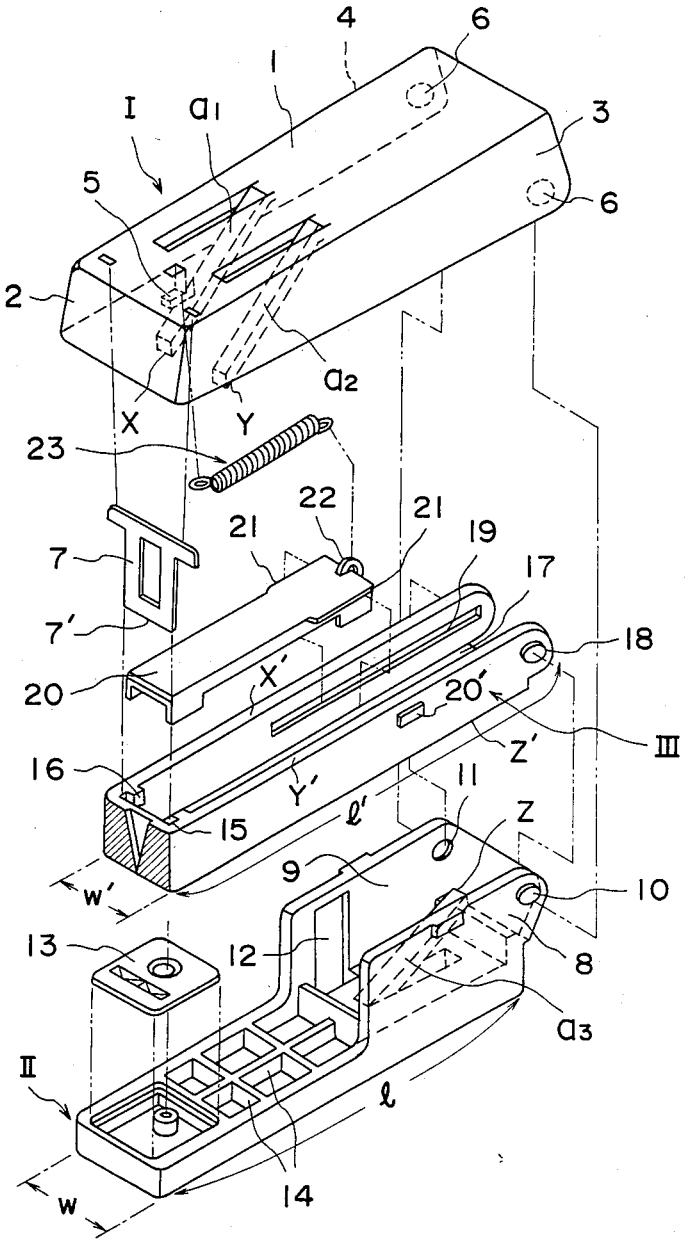
FIG. 1 is an exploded perspective view showing various members according to the present invention.

FIG. 1 is a perspective view of an assembly of a stapler in which the means for absorbing the elastic stress according to the present invention is shown. The guide body I is molded from a hard plastic material with elastic properties.

Edges 2, 3, 4 depending from an upper surface 1 of the guide body I can be seen in front and on both sides, thereof, respectively. A driver 7 on the guide body I is stably secured downward through a connector built within a wall formed behind the edge 2. A hook 5 for a conventional spring 23 having the elastic effect mentioned hereunder is fixed in relation to the above-mentioned edge 2.

When the base II is formed as illustrated in FIG. 1 by employing the same material as that of the guide body I or, alternatively, by employing a metal panel, the length l thereof is almost the same as that of the above-mentioned guide body I and the width w thereof is conventionally designed to be less than a corresponding width of the guide body I.

The base II is provided with an anvil 12 for a staple 24. An end portion 7' of the above-mentioned driver 7 cooperates with the anvil. The base II is further provided with a horizontal axis 10 through a hinge (not shown) about which the guide body I is rotatable by means of a manual operation at the rear end portion of the base II. For this purpose, latch holes 6 are perforated in the guide body I.

A stop 12 is formed by cutting open a section in a side wall 9 of the base II. Convex or concave portions 14 in the form of a frame for reinforcing physically the bottom surface of the base II are also formed in the base II.

The staple magazine III has such a width w' and a length l' sufficient to enter into the base II in a conventional manner. The staple magazine III is also provided with a horizontal axis 18 for a hinge (not shown) movable into a latching position by means of the holes 11 perforated along the horizontal axis 10 in the base II. The staple magazine III is further provided with a groove 15 into which the end portion 7' of the above-mentioned driver 7 may enter in front of a wall 16. A magazine follower 20 of the staple magazine III is arranged to contact a bottom 17 in order to allow sliding in of a plurality of staples 24 (FIG. 2) arranged in the bottom 17 of the staple magazine III in the back and forth direction by means of the elasticity of the spring 23.

Edges 21 of the magazine follower 20 engage with both grooves 19 cut into the side wall of the staple magazine III.

In the above construction of a stapler, a hook 22 of the magazine follower 20, a stop 20' of the staple magazine III, and a stop 12 of the base II engage with each other. The spring 23, elastically pulling said magazine follower 20, is latched between the hook 5 of the guide body I and the hook 22 on the end of the magazine follower 20.

The mechanism for absorbing the elastic stress according to the present invention with respect to the above-mentioned assembly will be described as set forth hereinunder.

Figure 2:
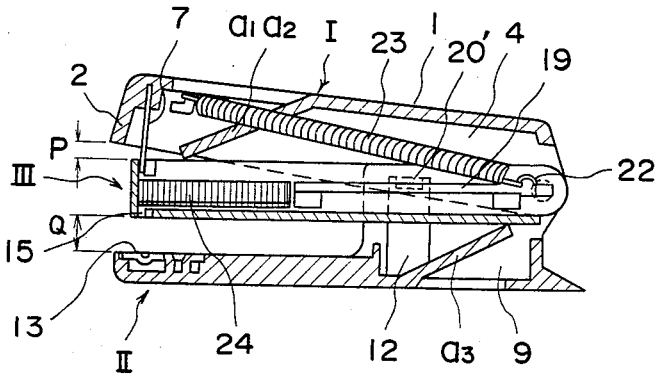
FIG. 2 is a cross-sectional view of the construction of a closed stapler in use according to the present invention.

Both of the front end portions X, Y of two (2) elastic pieces $a_1$,$a_2$ are in the shape of a board with a rectangular cross-section and are formed integrally with the guide body I by partially punching out and bending suitable portions of an upper surface at the front portion of the guide body I. These punched out portions X and Y are inclined downward in order to touch the top surfaces X' and Y' of both side walls of the staple magazine III, and thus the staple magazine is pushed down prior to use of the stapler (FIG. 2).

On the other hand, a third elastic piece $a_3$ in the shape of a board with a rectangular cross-section is formed integrally with the base II by partially punching out and bending an enclosed portion of the bottom surface of the base II. The elastic piece $a_3$ is inclined upwards in the direction of the horizontal axis 10 and is disposed so that an end portion Z may touch an external bottom surface Z' at the rear portion of the bottom 17 of the staple magazine III. Thus, the staple magazine III prior to use is open in the forward direction with a suitable gap existing in relation to the guide body I (FIG. 2).

In other words, the driver 7 prior to use may form gap P (FIG. 2) so as to be always positioned above a groove 15 in staple magazine III in which said driver 7 may contact a staple 24 when it is descending. Also prior to use, the staple magazine III and the base II form inevitably the open gap Q (FIG. 2).

Figure 3:
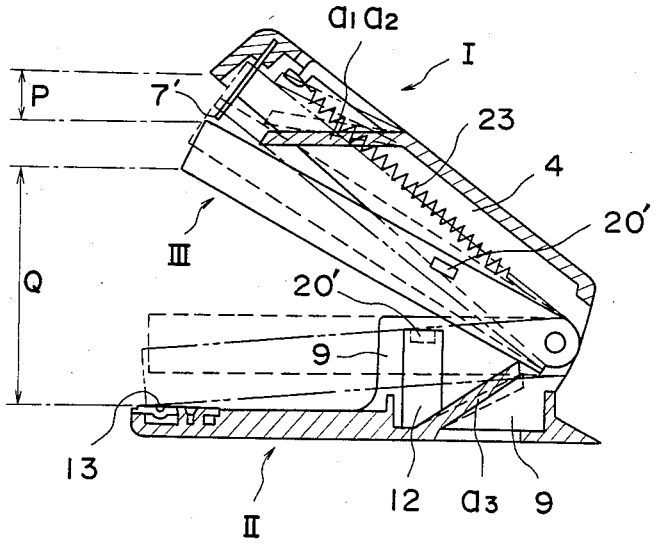
FIG. 3 is a cross-sectional view of the construction of an open stapler according to the present invention.

FIG. 3 exemplifies a degree of the opening between the gaps P and Q in the above-mentioned construction when the guide body I is manually opened upwardly.

Furthermore, in another embodiment not shown, the pieces $a_1$ and $a_2$ are respectively inclined upward at the central portions of the top surfaces of X' and Y' of the staple magazine III. At the same time, another piece $a_3$ is bent downward (not illustrated) at the rear portion of the bottom 17 of the same staple magazine III. Each of the pieces thus formed has been subjected to a test by contacting them against the corresponding portions of the guide body I and the base II; and the result showed the equivalency of the effect of the invention in this case, too.

Therefore, it is noted that such a mere change in design also belongs to the technical principles of the present invention.

Figure 4:
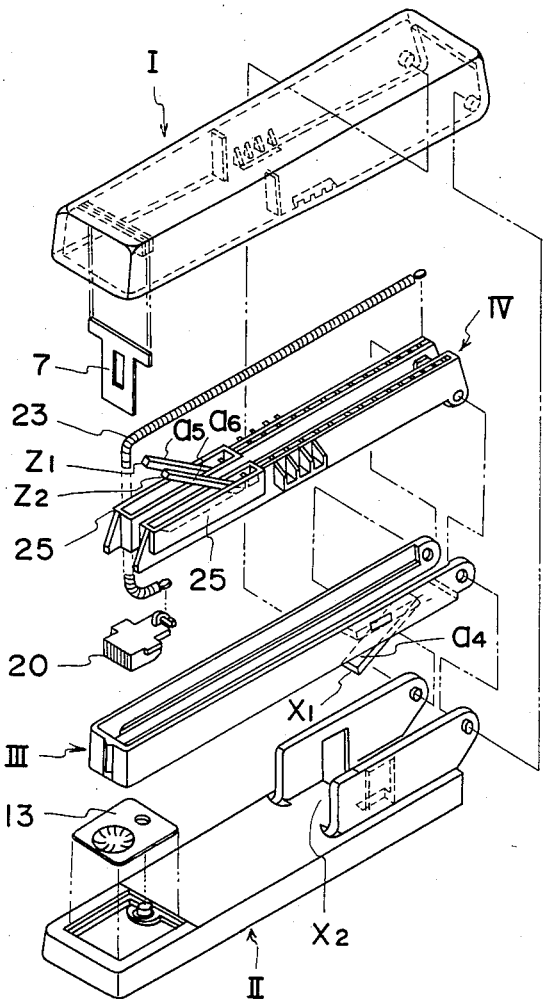
FIG. 4 is an exploded perspective view wherein the present invention is applied to a stapler provided with a frame cover.

Next, another embodiment (2) according to the present invention will be described with reference to the drawings which show a type of structure provided with a frame cover IV (FIG. 4).

The front end portion $X_1$ of an elastic piece $a_4$ is in the shape of a board made by partially punching out and bending the staple magazine III in FIG. 4 at the rear portion of the bottom surface thereof in like manner as the above-mentioned first embodiment (1) is formed. The front end portion $X_1$ is inclined downward so as to touch an upper surface of the base $X_2$.

Next, in order to form other elastic pieces $a_5$,$a_6$ on the frame cover IV, a pair of rectangular bottom surfaces of hollow small boxes 25 are preliminarily formed integrally with cover members in the direction from the front end portion of the frame cover IV to the rear position thereof.

Each bottom surface (not illustrated) of the boxes 25 is bent by partially punching them out so as to form the two (2) elastic pieces $a_5$,$a_6$.

Each of the pieces $a_5$,$a_6$ is formed to be inclined upwards. Furthermore, each of the front end portions $Z_1$,$Z_2$ is also constituted so as to touch a ceiling (not illustrated) within the guide body I, so that the same gaps P,Q (FIG. 5), as in the case of the first embodiment (1), may be formed. Accordingly, the guide body I and the staple magazine III may respectively be opened with a suitable gap existing in relation to the base II.

The effect with respect to each of the elastic stress pieces $a_1$ through $a_6$ formed as above according to the present invention will concisely be described as set forth hereinafter.

At the time of manual operation of the first embodiment (1) shown in FIGS. 1–3, the guide body I and the staple magazine III are pushed down against the pieces $a_1$,$a_2$ and $a_3$ when the guide body I is pushed down; and, accordingly, the gaps P,Q just prior to stapling are forcibly narrowed. Each of the plurality of staples 24 inserted in a conventional manner in the stapler is acted upon individually by the driver 7. At the same time, the driver 7 passes through the groove 15. In this case, the staple magazine III pushes down staples 24 on an object to be stapled (not illustrated), one by one, as the object is arranged on the anvil 13 of base II.

Also, in the case of the second embodiment (2), it is clear now that the above-mentioned operation can be equally carried out.

Thus, in order to reduce more and more the cost in production as one of the inevitable favorable effects of the present invention, the following structure is supplementally fixed to the guide body I.

Figure 6:
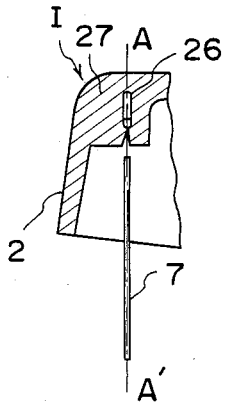
FIG. 6 is a partial sectional view of the guide body, as shown in FIG. 1 or FIG. 4, wherein a connector is shown for firmly connecting a driver embedded thereinto.

That is to say, as shown in FIG. 6, because the above-mentioned driver 7 is pushed into the connector of the guide body I in order to be secured thereto when assembling the stapler, a conventional means for securing the driver 7 to the side wall of a body formed by punching out and bending a portion thereof into the shape of an L can be eliminated according to the present invention.

In this embodiment, shown in FIG. 6, a sectional face 27 on the front end portion of the guide body I is molded to be thick. Furthermore, the guide body I is composed of an embedded connector 26 for the driver 7 with an inverse check element which does not slip down the groove 15.

Thus, elimination or reduction of the labor necessary for the securing operation of the driver is an advantageous result obtained by the present invention.

Figure 7:
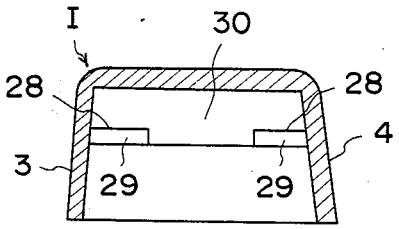
FIG. 7 is a cross-sectional view taken along line A—A' in FIG. 6.

FIG. 7 shows a cross-sectional view taken along line A—A' in FIG. 6 in the above-mentioned case. Element 28 in FIG. 7 is an inverse checking portion of the connector 26; element 29 is a nail portion for the connector 26; and element 30 is a cap for inserting the driver 7.

According to the present invention, any independent members are not necessary to be supplementally fixed as a mechanism for absorbing the elastic stress. In the prior art, it is impossible to obtain an equal advantage for a conventional stapler by miniaturizing the constructions of both a frame and a frame cover.

Another effect of the present invention provides considerable efficiency and reduced cost in the mass production of staplers because the number of members needed for absorbing the elastic stress can be manufactured by punching out the base materials of each stapler routinely.

What is claimed is:

1. A stapler having a base, a staple magazine hinged to the base, a magazine follower arranged in the staple magazine, and a guide body positioned over the staple magazine and hinged to the base, said stapler comprising:

at least one first punched-out means, extending between the guide body and a top surface of the staple magazine, for absorbing elastic stress created between the guide body and the staple magazine when the stapler is operated; and at least one second punched-out means, extending between the base and a bottom surface of the staple magazine, for absorbing elastic stress created between the base and the staple magazine when the stapler is operated.

2. The stapler, according to claim 1, wherein:

said at least one first punched-out means is bent downwardly from a central portion of the guide body and is inclined forwardly towards a front portion of the top surface of the staple magazine.

3. The stapler, according to claim 2, wherein:

said at least one second punched-out means is bent upwardly from the base and is inclined rearwardly towards a rear portion of the bottom surface of the staple magazine.

4. The stapler, according to claim 1, wherein:

said at least one first punched-out means is bent upwardly from the staple magazine and is inclined forwardly towards a front portion of an underside of the guide body.

5. The stapler, according to claim 4, wherein:

said at least one second punched-out means is bent downwardly from a rear portion of the bottom surface of the staple magazine and is inclined forwardly towards the base.

* * * * *